US009885210B2

(12) United States Patent
Haynes

(10) Patent No.: US 9,885,210 B2
(45) Date of Patent: Feb. 6, 2018

(54) THERMAL BREAK SYSTEM AND METHOD FOR DOORS AND WINDOWS

(71) Applicant: Robin Haynes, Durham, NC (US)

(72) Inventor: Robin Haynes, Durham, NC (US)

(73) Assignee: Donatello Doors Inc., Las Vegas, NV (US)

( * ) Notice: Subject to any disclaimer, the term of this patent is extended or adjusted under 35 U.S.C. 154(b) by 0 days.

(21) Appl. No.: 15/598,859

(22) Filed: May 18, 2017

(65) Prior Publication Data

US 2017/0254142 A1 Sep. 7, 2017

Related U.S. Application Data

(63) Continuation-in-part of application No. 15/297,113, filed on Oct. 18, 2016, now Pat. No. 9,816,310, which is a continuation-in-part of application No. 14/833,138, filed on Sep. 23, 2015, now Pat. No. 9,470,037.

(Continued)

(30) Foreign Application Priority Data

Jun. 23, 2016 (CN) ..... 2016 2 0628542 U

(51) Int. Cl.

| | |
|---|---|
| ***E06B 7/14*** | (2006.01) |
| ***E06B 1/70*** | (2006.01) |
| ***E06B 1/16*** | (2006.01) |
| ***E06B 1/22*** | (2006.01) |

(Continued)

(52) U.S. Cl.

CPC ..... *E06B 7/14* (2013.01); *E06B 1/16* (2013.01); *E06B 1/22* (2013.01); *E06B 1/52* (2013.01); *E06B 1/70* (2013.01); *E06B 7/16* (2013.01)

(58) Field of Classification Search

CPC ... E06B 1/18; E06B 1/12; E06B 1/325; E06B 2003/7076; E06B 3/26301; E06B 3/9616; E06B 1/70; E06B 2001/707; E06B 7/23; E06B 7/16; E06B 3/9632; E04B 1/08; E04B 2/7412; E04C 2003/0413; E04C 2003/043; E04C 2003/0465; E04C 3/07; E04C 3/29

See application file for complete search history.

(56) References Cited

U.S. PATENT DOCUMENTS 2,814,603 A 11/1957 Pirot
3,055,468 A * 9/1962 Horejs ..... E06B 3/26336 49/458

(Continued)

*Primary Examiner* — Joshua J Michener
*Assistant Examiner* — Matthew J Gitlin
(74) *Attorney, Agent, or Firm* — Christopher Pilling

(57) ABSTRACT

A door frame including an inside steel panel having a first inner surface and a first outer surface, and a C-shaped section with a first portion of the C-shaped section extending parallel to the inner surface of the inside steel panel; an outside steel panel having a second inner surface and a second outer surface, and a U-shaped section with a second portion of the C-shaped section extending perpendicular to the second inner surface of the outside steel panel; a first insulating material interposed between the first portion of the C-shaped section of the inside steel panel and the second inner surface of the outside steel panel to thermally isolate the inside steel panel and the outside steel panel from each other, and said inside steel panel and outside steel panel being secured together to form a thermal break system.

9 Claims, 2 Drawing Sheets

Related U.S. Application Data

(60) Provisional application No. 61/926,412, filed on Apr. 9, 2015.

(51) Int. Cl.
*E06B 1/52* (2006.01)
*E06B 7/16* (2006.01)

(56) References Cited

U.S. PATENT DOCUMENTS 3,436,885 A * 4/1969 Rothermel ..... E04B 2/62 52/207
3,837,134 A * 9/1974 DiFazio ..... E06B 3/825 52/784.13
3,908,313 A * 9/1975 Bierlich ..... E06B 3/26301 49/501
3,968,604 A * 7/1976 Hills ..... E04B 1/3205 52/745.07
4,107,893 A * 8/1978 Rensch ..... E04B 1/24 52/775
4,151,682 A 5/1979 Schmidt
4,183,393 A 1/1980 Bailey
4,524,112 A * 6/1985 Willert ..... E06B 3/273 428/595
4,594,831 A 1/1986 Winyard
4,897,971 A * 2/1990 Durston ..... E04C 2/36 428/116
4,930,257 A 6/1990 Windgassen
5,228,257 A 7/1993 Bowersox
6,430,888 B1 * 8/2002 Dombchik ..... E04C 3/06 52/653.1
6,568,149 B2 5/2003 Lacasse
6,962,025 B1 8/2005 Hill
7,562,497 B2 * 7/2009 Warren ..... E06B 1/006 52/211
8,186,132 B2 5/2012 Howerly, Jr.
8,516,756 B2 9/2013 Thielmann
8,615,942 B2 * 12/2013 Lafreniere ..... E04B 2/766 52/204.2
8,826,616 B1 9/2014 Gosselin
9,068,344 B2 * 6/2015 McKenna ..... E04B 1/78
2006/0096201 A1 * 5/2006 Daudet ..... E04B 1/24 52/272
2010/0088977 A1 4/2010 Darling
2010/0269450 A1 10/2010 Thielmann
2011/0283625 A1 11/2011 Lenox et al.
2012/0011793 A1 1/2012 Clark et al.
2012/0227338 A1 * 9/2012 Fitzpatrick ..... E06B 1/08 52/211

* cited by examiner

THERMAL BREAK SYSTEM AND METHOD FOR DOORS AND WINDOWS

CROSS-REFERENCE TO RELATED APPLICATION

The present application is a Continuation-In-Part Patent Application which claims priority to U.S. Utility patent application Ser. No. 15/297,113, filed on Oct. 18, 2018, entitled "Thermal break system and method for door and windows" which claims priority to U.S. Utility patent application Ser. No. 14/833,138, filed on Aug. 23, 2015, entitled "Thermal break system and method for door and windows", now U.S. Pat. No. 9,470,037 to issue Oct. 18, 2016, which claims priority to U.S. Provisional Patent Application Ser. No. 61/926,412, filed on Jan. 13, 2014, further this application claims priority to Chinese Patent Application serial number 201620628542.8, filed Jun. 23, 2016 the disclosures of which is hereby incorporated in its entirety at least by reference.

FIELD OF THE INVENTION

The present invention relates to the technical field of building materials, more particularly a thermal break system and method for doors and windows.

BACKGROUND OF THE INVENTION

Aluminum and other metals are often used for the structure of many doors and windows due to their strength and ductability, which facilitates the fabrication of strong windows and doors in a variety of shapes. However, the high conductivity of metal results in low thermal efficiency. Heat is conducted through the door or window structure, into the building on hot days and out of the building on cold days. Extra energy is required to offset this heat transfer and maintain a comfortable environment within the building. Also, on cold days, condensation or even frost can build up on the door or window structure, inside the building, potentially damaging floors and surrounding areas. Consequently, there is a need for a thermal break system that can limit heat transfer and provide energy-saving benefits.

BRIEF SUMMARY

In one aspect of the invention a door assembly is provided, comprising a door frame including an inside steel panel having a first inner surface and a first outer surface, and a C-shaped section with a first portion of the C-shaped section extending parallel to the inner surface of the inside steel panel; an outside steel panel having a second inner surface and a second outer surface, and a U-shaped section with a second portion of the C-shaped section extending perpendicular to the second inner surface of the outside steel panel; a first insulating material interposed between the first portion of the C-shaped section of the inside steel panel and the second inner surface of the outside steel panel to thermally isolate the inside steel panel and the outside steel panel from each other, and said inside steel panel and outside steel panel being secured together to form a thermal break system; and a doorjamb including a threshold comprising a second insulating material positioned between a first threshold portion and second threshold portion, wherein the first threshold portion is sloped to allow rainwater to discharge from the assembly; a third insulating material positioned above the second threshold portion adjacent to the second insulating material; a fourth and fifth insulating material positioned below the door fame, wherein the fourth insulating material is mounted parallel to a bottom portion of the door frame and the fifth insulating material is positioned at a right angle adjacent to the fourth insulating material proximal to the inside steel panel.

In one embodiment, a kerfed drop seal positioned on the bottom portion of the door frame is provided, wherein the kerfed drop seal comprises is a drip bead and a plurality of bottom sweeps. In one embodiment, an internal pressure seal positioned above the second threshold portion is provided, wherein the internal pressure reduces air infiltration. In another embodiment, the internal pressure seal is positioned between the third and fifth insulating materials.

In another aspect of the invention a door assembly is provided, comprising a door frame including a first side having a first inner surface, a first outer surface, a first edge, and a second edge, the distance between the first edge and second edge defining a first width; a first panel located at the first edge extending perpendicularly from the first inner surface at a first depth; a second panel located at the second edge extending perpendicularly from the first inner surface at a second depth; a first land perpendicularly connected to the first panel extending parallel to the first inner surface, the first land having a first length; a second land perpendicularly connected to the second panel extending parallel to the first inner surface, the second land having a second length; a second side having a second inner surface, a second outer surface, a third edge, and a fourth edge, the distance between the third edge and fourth edge defining a second width; a third panel located at the third edge extending perpendicularly from the second inner surface at a third depth; a fourth panel located at the fourth edge extending perpendicularly from the second inner surface at a fourth depth; a first thermal break having a third width positioned between the first land and the second inner surface adjacent to the third panel; a second thermal break having a fourth width positioned between the second land and the second inner surface adjacent to the fourth panel; the first width and the second width being identical; the first length, and third width being identical; the second length, and the fourth width being identical, the first depth and the second depth being identical; the third depth and the fourth depth being identical; wherein the outer surface of the first side is exposed to an external environment and the second outer surface of the second side is exposed to an internal environment; the third and fourth depths are greater than the first and second depths which correspond to the first and second thermal breaks being positioned closer to the external environment improving efficiency; and a plurality of metal screws clamping the first land and the first thermal break together and the second land and the second thermal break together, the plurality of metal screws providing mechanical strength.

In one embodiment, a first adhesive means joining the first thermal break, the second inner surface, and the third panel together is provided; and a second adhesive means joining the second thermal break, the second inner surface, and the fourth panel together is provided. In one embodiment, a doorjamb including a threshold comprising a third thermal break positioned between a first threshold portion and second threshold portion is provided, wherein the first threshold portion is sloped to allow rainwater to discharge from the assembly. In another embodiment, a kerfed drop seal positioned on a bottom portion of the door frame, wherein the kerfed drop seal comprises is a drip bead and a plurality of bottom sweeps. In one embodiment, an internal pressure seal positioned above the second threshold portion, wherein the internal pressure reduces air infiltration.

In yet another aspect of the invention, an assembly is provided comprising a frame including an inside steel panel having a first inner surface and a first outer surface, and a C-shaped section with a first portion of the C-shaped section extending parallel to the inner surface of the inside steel panel; an outside steel panel having a second inner surface and a second outer surface, and a U-shaped section with a second portion of the C-shaped section extending perpendicular to the second inner surface of the outside steel panel; a first insulating material interposed between the first portion of the C-shaped section of the inside steel panel and the second inner surface of the outside steel panel to thermally isolate the inside steel panel and the outside steel panel from each other, and said inside steel panel and outside steel panel being secured together to form a thermal break system.

In one embodiment, the frame is a door frame. In another embodiment, the frame is a window frame.

BRIEF DESCRIPTION OF THE DRAWINGS

Other features and advantages of the present invention will become apparent when the following detailed description is read in conjunction with the accompanying drawings, in which.

DESCRIPTION OF PREFERRED EMBODIMENT

The following description is provided to enable any person skilled in the art to make and use the invention and sets forth the best modes contemplated by the inventor of carrying out their invention. Various modifications, however, will remain readily apparent to those skilled in the art, since the general principles of the present invention have been defined herein to specifically provide a thermal break system and method for doors and windows.

Figure 1:
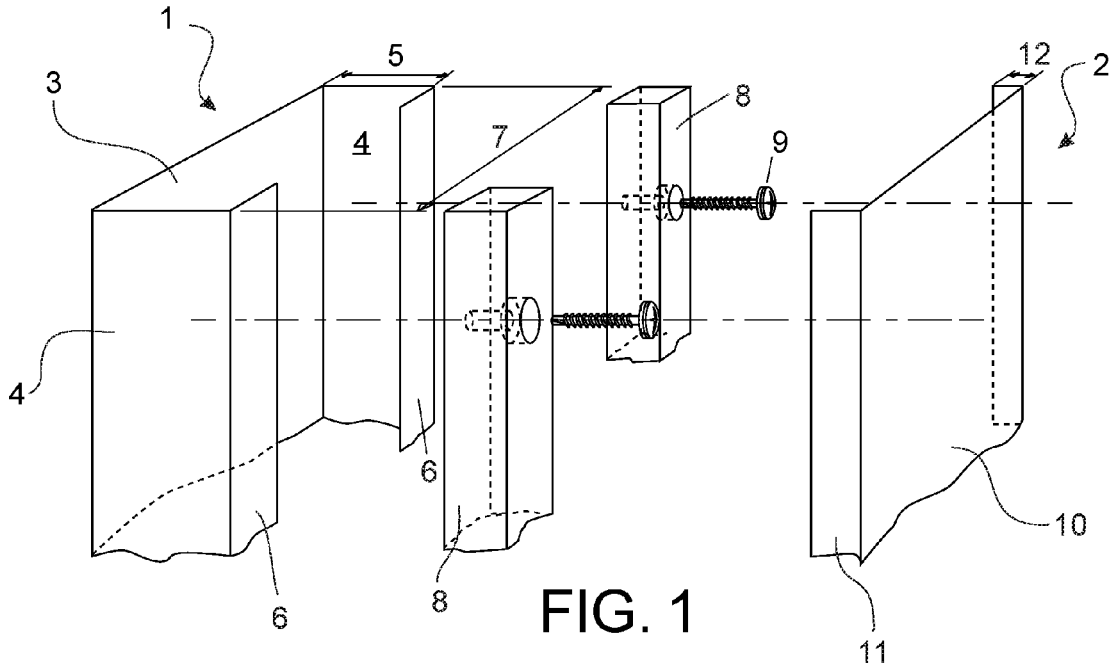
FIG. 1 is an exploded cross section view of a thermal break created in a straight tube assembly.
Figure 2:
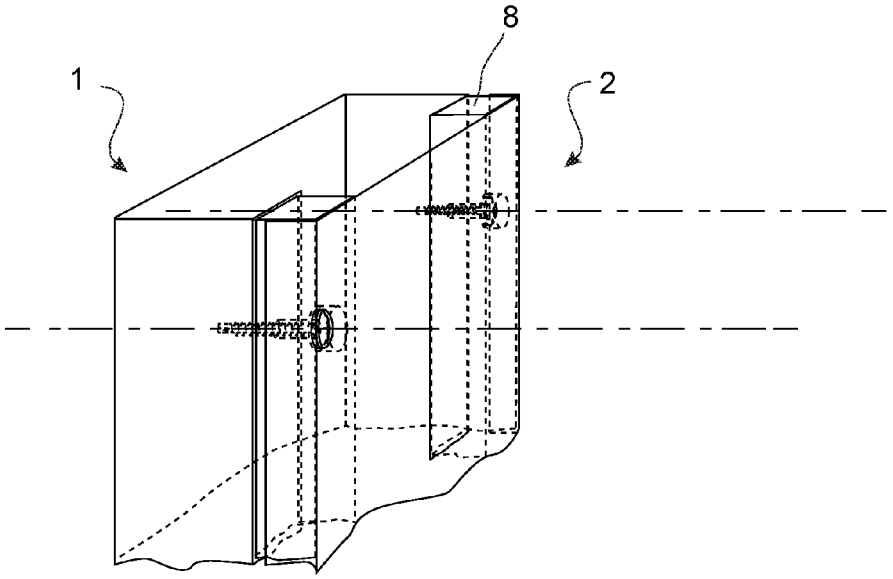
FIG. 2 is a cross-section view of a tube after construction shown with two sides connected through an insulating strip.
Figure 3:
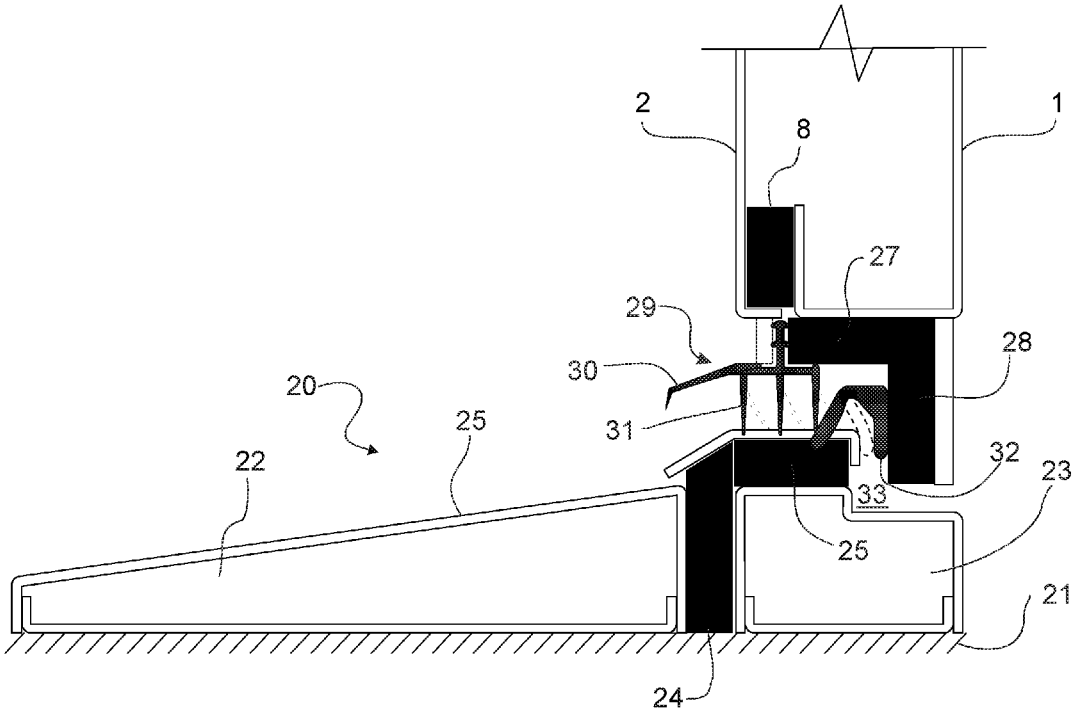
FIG. 3 is a cross-section view of a threshold according to the present invention.

FIGS. 1-3 illustrate a thermal break system and method for doors and windows is provided. FIGS. 1 and 2 illustrate exploded and cross section views of a thermal break created in a straight tube assembly for doors and windows. Referring now to FIG. 1, a tube is constructed using two sides, 1 and 2. One tube 1 is made up of an outer surface and an inner surface of an outside steel panel, for example, making up the surface of a door facing the exterior. The outer surface thereof faces the exterior of a building. The inner surface faces the tube 2 making up the panel facing the interior of a building. With respect to tube 2, its inner surface faces the inner surface of tube 1, and its outer surface faces the interior of a building when assembled. Tube 1 is comprised of a "C" shape profile having base member 3 with a pair of panels 4 extending from the base member at an equal depth 5. A pair of lands 6 extends from the pair of panels to complete the "C" shape profile. The sides terminate with the pair of lands having a width which is less than 50% of the width of profiles 1 and 2, determined by the strength requirement of the particular application. Insulating strips 8, with a width approximately the same as the pair of lands, and a depth sufficient to provide the degree of insulation required, are sandwiched between profiles 1 and 2. The insulating strips are joined to tube 1 using a plurality of self-drilling, self-tapping screws 9 in combination with an adhesive means applied to adjacent faces of lands 6, and insulating strips 8. Typical adhesives useful for the invention include Liquid Nails, Bostick, Dap or Tightbond. Alternative screw arrangements may be self-tapping but not self-drilling, in which case suitable pilot holes may be pre-drilled in lands 6, as well as insulating strips 8.

Still referring now to FIG. 1, tube 2 is comprised of a "U" shape profile having a second base member 10 with a second pair of panels 11 extending from the second base member at an equal depth 12. During installation, an adhesive means is applied to the second base member and/or the second pair of panels. The screws are not used on tube 2, only the adhesive means.

It is a particular advantage of the present invention that the insulating strips 8 are positioned completely towards tube 2 of the assembly, or the the outside, that is the thermal break is positioned closer to the exterior. This configuration reduces the mass on the outside panel or side 2. Further since the weight of the door is carried by the side 1, it lowers stress on door joints and reduces exposure of the outside panel to elements which improves efficiency. The tube assemblies may be constructed of steel, aluminum, copper or aluminum alloy, or any other conductive material that would require a thermal break in order to control heat transfer. This design approach can be very effective in reducing the energy exchange, energy conservation in cold areas play a positive role. It is a particular advantage of the present invention to protect the doors and windows in cold areas to prevent damage to the doors and windows via frost.

FIG. 2 shows a cross section of the tube after construction where the sides 1 and 2 are connected with insulating strips 8, typically made of ABS, sandwiched between them.

FIG. 3 is a cross-section view of a threshold 20 on a ground surface 21 according to the present invention. Referring now to FIG. 3, a first insulation 24 (thermal break) is positioned toward the inner end of an outer threshold portion 22, and toward the inside of an inner threshold portion 23 constituting the intermediate heat shield. Preferably, threshold portions 22 and 23 are foam filled. The outside of the front end of the threshold comprises a slope 25, which helps discharge rainwater. A second insulation 25 is positioned above the inner threshold portion adjacent to the first insulation. A third and fourth insulation 27 and 28 are positioned below the door, wherein the third insulation is mounted directly below the door, while the fourth insulation is positioned at a right angle adjacent to the third insulation towards tube side 1 proximal to the interior of the building. In one embodiment, the insulations are constructed from a thermoplastic, such as acrylonitrile butadiene styrene (ABS) approximately 10 mm thick.

In one embodiment, a kerfed drop seal 29 positioned on the bottom edge of the door is provided. It is a particular advantage that the drop seal is a combined drip bead 30 and bottom sweeps 31. The drip bead is a downward slope element or drip guard to direct rainwater to slope 25. The bottom sweeps prevents air and water outside from entering into the building from the outside and provides the heat insulation effect. In one embodiment, three bottoms sweeps are provided. An internal pressure seal 32 is included above the center of the inner threshold portion above space 33, wherein the seal provides insulation while reducing air infiltration. The dotted lines show the seal deflected in the space under pressure.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

What is claimed is:

1. A door assembly comprising:

a door frame including an inside steel panel having a C-shaped section; an outside steel panel having a U-shaped section a first insulating material interposed between the C-shaped section and the outside steel panel to the thermally isolate the inside steel panel and the outside steel panel from each other, and said inside steel panel and outside steel panel being secured together to form a thermal break system; and a doorjamb including a threshold comprising a second insulating material positioned between a first threshold portion and second threshold portion, wherein the first threshold portion is sloped to allow rainwater to discharge from the assembly; a third insulating material positioned above the second threshold portion adjacent to the second insulating material; a fourth and fifth insulating material positioned below the door fame, wherein the fourth insulating material is mounted parallel to a bottom portion of the door frame and the fifth insulating material is positioned at a right angle adjacent to the fourth insulating material proximal to the inside steel panel.

2. The door assembly of claim 1, further comprising a kerfed drop seal positioned on the bottom portion of the door frame, wherein the kerfed drop seal comprises is a drip bead and a plurality of bottom sweeps.

3. The door assembly of claim 1, further comprising an internal pressure seal positioned above the second threshold portion, wherein the internal pressure reduces air infiltration.

4. The door assembly of claim 3, wherein the internal pressure seal is positioned between the third and fifth insulating materials.

5. A door assembly comprising:

a door frame including a first side having a first inner surface, a first outer surface, a first edge, and a second edge, the distance between the first edge and second edge defining a first width; a first panel located at the first edge extending perpendicularly from the first inner surface at a first depth; a second panel located at the second edge extending perpendicularly from the first inner surface at a second depth; a first land perpendicularly connected to the first panel extending parallel to the first inner surface, the first land having a first length; a second land perpendicularly connected to the second panel extending parallel to the first inner surface, the second land having a second length; a second side having a second inner surface, a second outer surface, a third edge, and a fourth edge, the distance between the third edge and fourth edge defining a second width; a third panel located at the third edge extending perpendicularly from the second inner surface at a third depth; a fourth panel located at the fourth edge extending perpendicularly from the second inner surface at a fourth depth; a first thermal break having a third width positioned between the first land and the second inner surface adjacent to the third panel; a second thermal break having a fourth width positioned between the second land and the second inner surface adjacent to the fourth panel; the first width and the second width being identical; the first length, and third width being identical; the second length, and the fourth width being identical; the first depth and the second depth being identical; the third depth and the fourth depth being identical; wherein the first outer surface of the first side is exposed to an external environment and the second outer surface of the second side is exposed to an internal environment; the third and fourth depths are greater than the first and second depths which correspond to the first and second thermal breaks being positioned closer to the external environment improving efficiency; and a plurality of metal screws clamping first land and the first thermal break together and the second land and the second thermal break together, the plurality of metal screws providing mechanical strength.

6. The door assembly of claim 5, further comprising a first adhesive joining the first thermal break, the second inner surface, and the third panel together; and a second adhesive joining the second thermal break, the second inner surface, and the fourth panel together.

7. The door assembly of claim 5, further comprising a doorjamb including a threshold comprising a third thermal break positioned between a first threshold portion and second threshold portion, wherein the first threshold portion is sloped to allow rainwater to discharge from the assembly.

8. The door assembly of claim 5, further comprising a kerfed drop seal positioned on a bottom portion of the door frame, wherein the kerfed drop seal includes a drip bead and a plurality of bottom sweeps.

9. The door assembly of claim 5, further comprising an internal pressure seal positioned above the second threshold portion, wherein the internal pressure reduces air infiltration.

* * * * *